US005271332A

United States Patent [19]

Guirguis

[11] Patent Number: 5,271,332

[45] Date of Patent: Dec. 21, 1993

[54] MODIFIED CHANNEL EFFECT FOR SOLID EXPLOSIVE DETONATION WAVES

[75] Inventor: Raafat H. Guirguis, Fairfax, Va.

[73] Assignee: The United States of America as represented by the Secretary of the Navy, Washington, D.C.

[21] Appl. No.: 955,800

[22] Filed: Oct. 2, 1992

[51] Int. Cl.[5] ..... F42B 12/10

[52] U.S. Cl. ..... 102/476; 102/283; 102/293; 102/305; 102/306; 102/473; 102/475

[58] Field of Search ..... 102/283-292, 102/293, 303-310, 473, 475, 476, 701

[56] References Cited

U.S. PATENT DOCUMENTS

| | | | |
|---|---|---|---|
| 2,628,559 | 2/1953 | Jasse | 102/306 |
| 3,218,975 | 11/1965 | Massey | 102/476 |
| 3,407,736 | 10/1968 | Beuschel | 102/291 |
| 3,721,192 | 3/1973 | McEwan et al. | 102/476 |
| 4,291,624 | 9/1981 | Sabronski | 102/476 |

FOREIGN PATENT DOCUMENTS

| | | | |
|---|---|---|---|
| 659660 | 3/1963 | Canada | 102/476 |
| 2523713 | 2/1989 | France | 102/476 |
| 907878 | 10/1962 | United Kingdom | 102/476 |
| 918235 | 2/1963 | United Kingdom | 102/476 |

*Primary Examiner*—Harold J. Tudor
*Attorney, Agent, or Firm*—John D. Lewis; Jacob Shuster

[57] ABSTRACT

The detonation wave velocity in a solid explosive body of material, increased by the "channel effect", is further increased by compounding of the "channel effect" and/or by partial shock wave interruption by means of a threaded or rifled passage wall surface in a continuous, open channel arrangement. The high velocity detonation wave can be used to increase the jet velocity of shaped charges.

10 Claims, 2 Drawing Sheets

MODIFIED CHANNEL EFFECT FOR SOLID EXPLOSIVE DETONATION WAVES

BACKGROUND OF THE INVENTION

This invention relates in general to the propagation of signal energy within solid material, such as detonation waves conducted through bulk explosives, and the effect thereon of shock waves propagated more rapidly through the bulk material.

The invention is more particularly applicable to solid explosives wherein shock waves are generated in longitudinal cavities or channels formed in the explosive material. Propagation of the shock waves at velocities higher than the detonation waves in the channels and the resulting increase in detonation velocity is known as the "channel effect", which is modified in accordance with the present invention.

In connection with explosives, it is already well known that propagation of self-sustaining detonation waves at a prescribed wave velocity is responsible for rapid consumption of the explosive material. Such self-sustained detonation waves are furthermore known to increase in velocity with the density of the explosive material through which the detonation wave is propagated.

It is also known in the art that the detonation wave velocity in a tubular or hollow type explosive is higher than that in a solid body explosive. The increase in magnitude of the detonation wave velocity beyond its otherwise established limits is caused by a shock wave generated in the channel of the tubular explosive, the shock wave being propagated through the channel passage at a velocity higher than that of the detonation wave in the annular portion of the explosive in surrounding relation to the channel. Such higher velocity shock wave in the channel compresses the solid particles of the explosive material, within the annular portion of the explosive body forwardly of the detonation wave, to locally increase explosive density with a corresponding increase in the self-sustained detonation wave velocity. The resulting detonation velocity approaches that of the explosive powder when fully compressed to crystal density. Such increase in the detonation velocity resulting from what is known as the "channel effect", is less for explosive charges of higher original density.

It is also known that the effective detonation wave velocity may be further increased beyond what is possible as a result of the aforementioned "channel effect", by periodic blockage of shock wave propagation through the channel passage by means of bulk material disposed between adjacent axial ends of a plurality of axially aligned cavities in a multiple-cavity type of tubular explosive. In such a multiple-cavity arrangement, reflection of the shock wave at the end of each cavity initiates the explosive material thereat to generate two new detonation waves respectively propagated forwardly and rearwardly while a new shock wave is generated in the following cavity after some delay. When the detonation wave propagating forwardly collides with the rearwardly directed detonation wave generated at the end of the cavity, pressure oscillations not present in continuous, open channel type cavity arrangements are produced. Nevertheless, the rate of explosive consumption is increased, corresponding to an increase in the average detonation wave velocity.

It is an important object of the present invention to provide a continuous open channel type of cavity arrangement in a solid explosive capable of increasing detonation to an ultra-high wave velocity greater than the increase in velocity heretofore achieved by periodic blockage of shock waves within multiple-cavity arrangements, and without the previous oscillations associated therewith.

In accordance with the foregoing object, it is a further object to exploit the ultra-high velocity effect to increase jet velocity in shaped charges, reduce the angle between detonation front and liner in such shaped charges and control wave profile in plane wave lenses.

SUMMARY OF THE INVENTION

In accordance with the present invention, propagation of shock waves in longitudinal cavities or channels formed in a solid bulk material of predetermined density increases detonation wave velocity beyond the limits heretofore imposed by explosive material density in traditional continuous, open channel and multiple-cavity arrangements by virtue of a novel configuration involving, according to certain embodiments, the threading or rifling of the internal passage wall surfaces of certain cavities. The resulting characteristics of the detonation wave propagated through the solid portions of the bulk material is unexpectedly smooth but with a significantly higher detonation wave velocity despite high original bulk density for explosive in powder form pressed to near crystal density.

According to of the invention, the novel cavity configuration involves a plurality of channel passages circumferentially spaced about a central cavity and extending generally in the axial passage direction. Plural shock waves propagated within the respective channel passages interact to produce a compounding of the aforementioned "channel effect" resulting in a further increase in detonation wave velocity, even with the cavity passages being smooth bored. Where one or more of the cavity passages is internally threaded or rifled as aforementioned the increase in detonation wave velocity is even greater.

In connection with embodiments utilizing internally threaded channels, the passage wall surfaces have a helical thread-shape. Where the explosive sensitivity is low, the threaded wall surfaces may be formed by a material of greater sensitivity than the body of the material through which the detonation wave is propagated. A higher detonation wave velocity may thereby be achieved without the pressure oscillations heretofore associated with shock wave blocking action and detonation collisions in a multiple cavity type of tubular explosive.

According to still other embodiments of the invention, the aforementioned compounding of the "channel effect" is applied to shaped charges, in order to increase jet velocity of the shaped charge.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENTS

Figure 1:
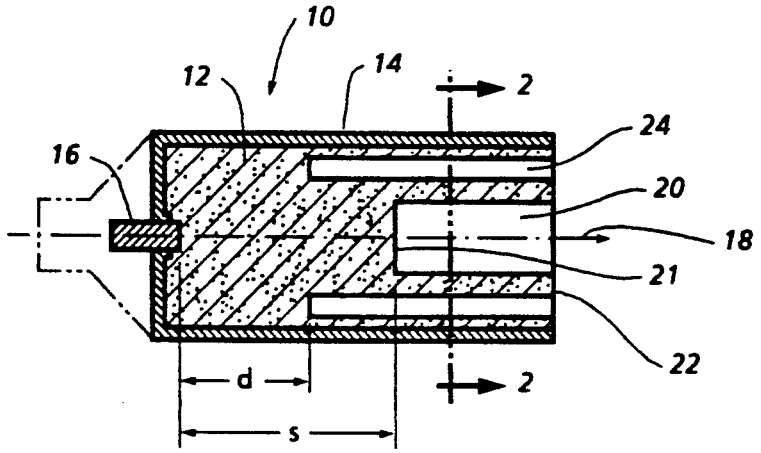
FIG. 1 is a side section view through an explosive charge with which the present invention is associated in accordance with one embodiment thereof.
Figure 2:
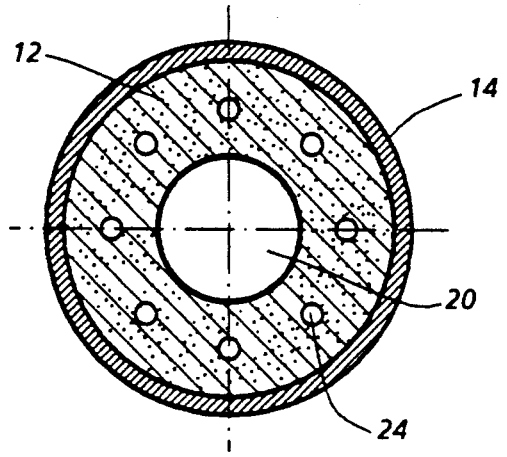
FIG. 2 is a transverse section view taken through a plane indicated by section line 2—2 in FIG. 1.

Referring now to the drawing in detail, FIGS. 1 and 2 illustrate an explosive munition round, generally referred to by reference numeral 10 as a typical environment for the present invention. As shown, the round 10 has a generally cylindrical body of solid explosive material 12 of predetermined sensitivity and density, enclosed by a casing 14. An ignition detonator 16 projects into the body of explosive material 12 at one axial end. When energized, the detonator 16 initiates a detonation wave in the body of material 12 that propagates forwardly therethrough in a direction along its axis 18. The body of explosive material 12 may be fully consumed by a self-sustained energy wave having a detonation wave velocity dependent on the density of the explosive material, as already well known in the art.

According to the embodiment shown in FIGS. 1 and 2, a central cylindrical cavity 20 forms a hollow chamber within the body of explosive 12. The cavity 20 extends continuously along axis 18 from an inner end 21 thereof to an open exit end 22 as shown. The inner end 21 is spaced a distance (s) through the body of explsoive material 12 from the detonator 16. As already known in the art, in the absence of the circumferentially surrounding channels 24 within the body of explosvie material the products of detonation produce a shock wave in cavity 20 propagated at a higher velocity than the explosive detonation wave. The shock wave is propagated through the air initially filling cavity 20 and compresses the explosive material ahead of the detonation wave within the annular portion of the body of explosive material 12 surrounding the cavity 20. The localized increase in density of the explosive material resulting therefrom, correspondingly increases the average self-sustaining detonation velocity of the energy wave through the entire body of explosive material 12. The foregoing shock wave action is generally referred to as a "channel effect".

In accordance with the embodiment of the invention shown in FIGS. 1 and 2, the detonation velocity is further increased by the compounding of the "channel effect" resulting from a plurality of the channel passages or bores 24 formed within the body of explosive material 12 in a cross-sectionally annular arrangement surrounding central cavity 20. The channel passages 24 extend continuously to exit end 22, parallel to axis 18, from an axial start location spaced a shorter distance (d) from the detonator 16 than the distance(s) in order to establish an initial run distance (s-d) accommodating generation of additional shock waves produced within the respective channel passages 24. The additional shock waves in the channel passages locally increase the explosive density and detonation velocity in the bulk of explosive surrounding cavity 20. As a result, the velocity of the shock waves in cavity 20 further increase the overall detonation velocity in the explosive bulk surrounding cavity 20. Such compounding of the "channel effect" occurs whether or not the channel passages 24 are smooth or rifled.

Figure 3:
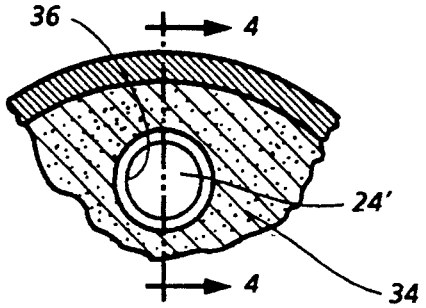
FIG. 3 is a partial transverse section view illustrating a portion of an explosive charge embodying the present invention in accordance with another embodiment thereof.
Figure 4:
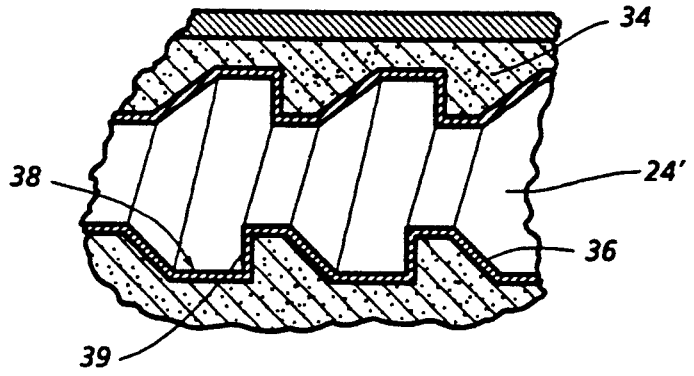
FIG. 4 is a partial side section view taken substantially through a plane indicated by section line 4—4 in FIG. 3.

According to yet another embodiment of the invention as depicted in FIGS. 3 and 4, the "channel effect" is modified to increase the detonation velocity even further by periodic partial blocking of the shock wave traveling through a channel passage 24'. Such partial blocking of the shock wave does not produce the pressure oscillations heretofore experienced from use of full blockage of a shock wave through a channel passage. More rapid detonation and higher shock wave velocities are thereby achieved, beyond the the capability of smooth continuous channel passages or fully interrupted channels. Partial interruption of shock wave propagation through the channel passage 24' extending through a body of explosive 34 as shown in FIGS. 3 and 4, occurs because the passage 24' has an internal helical screw thread type of surface 36. If the bulk of explosive is not sensitive enough, the helical surface may be coated or lined with a thin lining 38 of explosive material that is more sensitive than that of the surrounding body of explosive 34. The thread profile, height and pitch of surface 36 between impact portions 39 thereof as shown in FIG. 4, is designed to locally induce ignition of the explosive when the shock wave being propagated through channel passage 24' impacts the portions 39 of surface 36. A three dimensional wave interaction thereby occurs, much milder than the head-on wave collisions heretofore experienced in fully interrupted channels.

Figure 5:
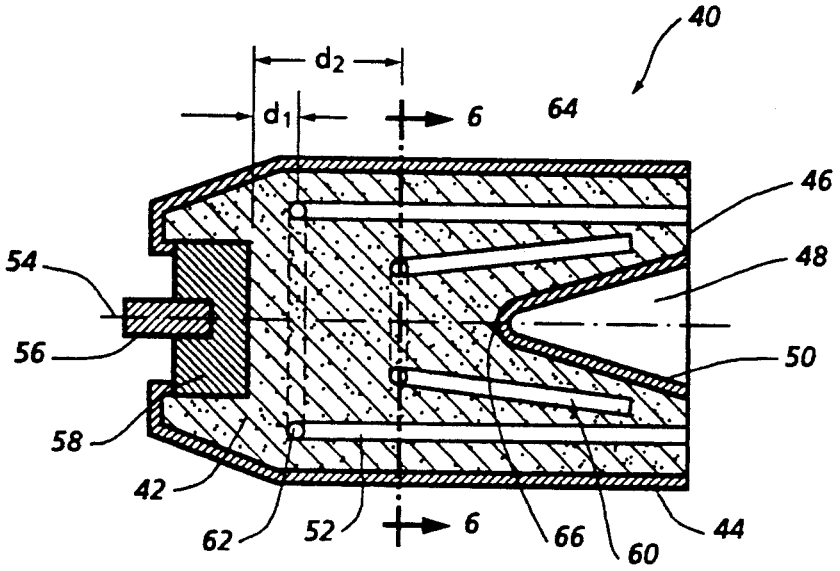
FIG. 5 is a side section view through a shaped charge type of explosive round embodying the present invention in accordance with yet another embodiment thereof.
Figure 6:
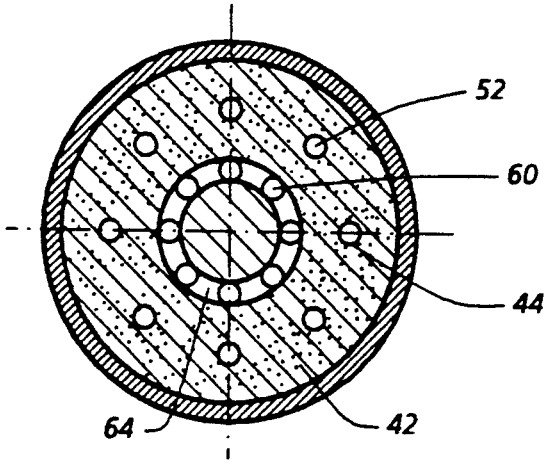
FIG. 6 is a transverse section view taken substantially through a plane indicated by section line 6—6 in FIG. 5.

The increase in the denotation velocity is achieved without the pressure oscillations associated with multiple cavities in accordance with embodiments of the invention as hereinbefore described with respect to FIGS. 3 and 4. The embodiments described with respect to FIGS. 1 and 2, on the other hand, result in the compounding of the "channel effects" to also achieve higher detonation velocities. Such embodiments of the invention, respectively shown in FIGS. 1 and 4, embody novel features which may be utilized individually or in combination for shaped charges to increase the jet velocity in accordance with yet another embodiment of the invention as illustrated in FIGS. 5 and 6. As shown in FIG. 5, the shaped charge generally referred to by reference numeral 40 includes an explosive fill 42 enclosed by a cylindrical casing 44 in surrounding relation to a central conical cavity 48 extending inward from an exit end 46 of the shaped charge. The cavity 48 is lined by a conical liner 50 of uniform thickness. Within the body of explosive, several circumferentially spaced channel passage bores 52 are formed generally parallel to the axis 54 of the shaped charge 40. A detonator 56 and a booster/wave shaper 58 are embedded in the explosive fill 42 at its rear end. Another annular series of circumferentially spaced channel passages 60 are formed in the explosive fill spaced radially inwardly of the channel passages 52 at an angle to the axis 54. Each annular series of channel passages 52 and 60 are respectively interconnected at their inner ends by axially spaced annular connector passages 62 and 64. While the channel passages 52 are open at the exit end 46 of the charge 40 as shown in FIG. 5, the channel passages 60 terminate within the explosive fill adjacent the exit end forwardly of the apex 66 of the conical liner 50.

Connector passage 64 is axially spaced from booster/-wave shaper 58 by distance (d2) to allow the detonation action an initial propagation distance for stabilization and attainment of coherent conditions, whereby the products of detonation in channels 60 are responsible for sustaining the shock waves therein. For correspondingly similar reasons, the connector passage 62 is axially spaced by distance ($d_1$) from shaper 58. The channel passages 52 and 60 are filled with air at atmospheric or higher pressure, or with other gases such as argon or xenon at possibly different pressures to provide higher shock temperatures capable of providing better ignition of the sensitive liner 50. The pressures, densities and other initial conditions within the channel passages 52 and 60 of each annular series are equalized by the connector passages 62 and 64 to insure symmetrical collapse of liner 50 in response to detonation of the charge 40 producing a higher jet velocity.

It will be apparent from the foregoing description that desired detonation velocity along a channel may be obtained by selective size control. Also, plane wave lenses may be produced by increasing the velocity adjacent the lateral surface of a cylindrical-shaped explosive charge having circumferentially spaced channels. In cylindrical-shaped explosives, detonation is usually slower adjacent the surface to produce a curved wave. By increasing the detonation velocity adjacent the surface in accordance with the present invention, a plane wave may be produced.

Other modifications and variations of the present invention are possible in light of the foregoing teachings. It is therefore to be understood that within the scope of the appended claims the invention may be practiced otherwise than as specifically described.

What is claimed is:

1. In combination with a solid body of explosive material through which a detonation wave is propagated in one direction at a self-sustaining velocity, an axially extending cavity through which a shock wave is propagated forwardly of the detonation wave within said body of explosive material along said one direction and means for modifying said self-sustaining velocity, including a plurality of internally threaded channel passages formed within said body of explosive material in circumferentially spaced relation to each other and in radially spaced surrounding relation to said cavity.

2. The combination of claim 1 wherein each of said channel passages further includes a liner internally coating the internally threaded passage, said liner being made of an explosive of greater sensitivity than that of said body of explosive material.

3. The combination of claim 1 wherein at least some of said channel passages are parallel to said one direction.

4. The combination of claim 3 wherein said cavity is conical shaped and has an apex aligned with an axis extending through the body of explosive material parallel to said one direction.

5. The combination of claim 4 wherein said means for modifying further includes an annular connector passage formed within said body of explosive material interconnecting the channel passages.

6. In combination with a solid-state body of explosive material through which an energy wave is propagated in one direction at a self-sustaining velocity, channel means for conducting a shock wave generated in response to said energy wave propagated in said one direction, said channel means comprising a central cavity, continuous passages within said body of explosive material extending in circumferentially surrounding radially spaced relation to said central cavity and surface means internally formed in at least one of the continuous passages for partial interruption of the shock wave propagated therethrough.

7. The combination of claim 6 wherein said body of explosive material has a predetermined sensitivity and said surface means comprises an explosive liner of greater sensitivity than said body of explosive material.

8. In combination with a detonator and a solid explosive body of predetermined density through which a detonation wave from the detonator is propagated in one direction at a self-sustaining velocity, said body having an axial end into which the detonator projects and an opposite exit end cavity means within said explosive body spaced from the detonator at said axial end for propagation of a shock wave forwardly of the detonation wave to increase the predetermined density of localized portions of the explosive body and shock wave modifying means extending through said localized portions of the explosive body in circumferentially surrounding relation to the cavity means for increasing differential between velocities of the detonation wave and the shock wave, including a plurality of continuous channel passages through which additional interacting shock waves are respectively propagated generally parallel to the shock wave propagated in the cavity means in said one direction, said continuous channel passages being open at said exit end in radially spaced relation to the cavity means.

9. The combination of claim 8 wherein at least one of said continuous channel passages of the shock wave modifying means has internal surface means for periodic impact by the shock wave propagated therethrough.

10. The improvement as defined in claim 8 wherein said channel passages are axially spaced from the detonator closer than the cavity means.

* * * * *